US010556453B2

(12) United States Patent
Watanabe

(10) Patent No.: US 10,556,453 B2
(45) Date of Patent: Feb. 11, 2020

(54) PRINTER AND CONTROL METHOD

(71) Applicant: SEIKO EPSON CORPORATION, Tokyo (JP)

(72) Inventor: Ikumi Watanabe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/804,234

(22) Filed: Nov. 6, 2017

(65) Prior Publication Data

US 2018/0141352 A1 May 24, 2018

(30) Foreign Application Priority Data

Nov. 21, 2016 (JP) ..... 2016-225701

(51) Int. Cl.
*B41J 13/00* (2006.01)
*G03G 15/00* (2006.01)

(52) U.S. Cl.
CPC ..... *B41J 13/0009* (2013.01); *B41J 13/0018* (2013.01); *G03G 15/6508* (2013.01)

(58) Field of Classification Search
CPC ..... B41J 13/0009; B41J 13/0018; G03G 15/6508
See application file for complete search history.

(56) References Cited

U.S. PATENT DOCUMENTS 7,539,454 B2 * 5/2009 Nishikawa ..... B41J 3/44 399/392
7,916,325 B2 * 3/2011 Ebuchi ..... G06F 3/1207 358/1.15
2009/0166949 A1 * 7/2009 Unno ..... B41J 11/485 271/9.03

FOREIGN PATENT DOCUMENTS

JP 2010-224849 A 10/2010

OTHER PUBLICATIONS

IP.com search (Year: 2018).*
Wikipedia Article "Photographic Paper", Sections: Introduction and Structure (Year: 2018).*
IP.com search (Year: 2019).*

* cited by examiner

*Primary Examiner* — Lisa Solomon
(74) *Attorney, Agent, or Firm* — Global Counselors, LLP

(57) ABSTRACT

Provided is a printer that continues printing using an alternate paper feed port when the paper stocked in the paper feed port being used for printing becomes exhausted while printing, providing excellent usability and preventing using inappropriate paper. A printing device capable of alternate printing using a second paper set in a different paper feed port when first paper set in a first paper feed port and used for printing is depleted, includes: a print job receiver that receives print jobs including printing conditions; a paper information acquisition unit that acquires paper information about paper set in the paper feed ports; a no-paper detector; a paper feed port selector that selects a paper feed port based on the printing conditions and paper information. The paper feed port selector, when the no-paper detector detects there is no first paper, the paper size of the first paper and the second paper is the same, and the paper type of the first paper and the second paper are included in the same group of type groups, selects the paper feed port in which the second paper is set as the paper feed port for alternate printing.

13 Claims, 5 Drawing Sheets

PRINTER AND CONTROL METHOD

BACKGROUND

1. Technical Field

The present invention relates to a printer that continues printing using an alternate paper supply means when the paper supply means supplying paper runs out of paper, and relates more particularly to a printer capable of printing using a high usability, alternate paper supply without using inappropriate paper.

2. Related Art

Printers that have multiple paper supply entrances in which different types of print medium may be loaded, and select the desired paper therefrom for printing, are now common. Some such printers can normally be set to enable automatic selection of the paper supply, and automatic selection is enabled, the print selects the appropriate paper supply for printing. Some printers also have an alternate printing function that enables supplying paper from a different paper supply to continue printing when the selected paper supply runs out of paper while printing.

JP-A-2003-280853 describes an alternate printing technology that, when the paper supply runs out, picks paper from the supply tray in which the same size of paper is loaded and continues printing regardless of the paper orientation in the job settings.

However, the deciding factor in the method described in JP-A-2003-280853 for continuing printing when the paper runs out while printing is matching the paper size, and the paper type is not considered. As a result, when the user installs different types of paper, different paper types may be mixed into a single print job, resulting in such problems as a poor appearance in the final printout.

A printer according to the invention continues printing using an alternate paper feed port when the paper stocked in the paper feed port being used for printing becomes exhausted while printing, providing excellent usability and preventing using inappropriate paper.

SUMMARY

To achieve the foregoing objective, a first aspect of the invention is a printing device having multiple paper feed ports, executing alternate printing using a second paper set in a different paper feed port when first paper set in a first paper feed port and used for printing is depleted, and including: a print job receiver configured to receive a print job including printing conditions; a paper information acquisition unit configured to acquire paper information about paper set in the paper feed ports; a no-paper detector configured to detect depletion of the paper set in the paper feed port; a paper feed port selector configured to select a paper feed port based on the printing conditions and paper information; and a printing process controller configured to supply paper from the selected paper feed port and print; the paper feed port selector, when the no-paper detector detects depletion of the first paper, the paper size of the first paper and the second paper is the same, and the paper type of the first paper and the second paper is included in the same group of predetermined paper type groups, selects the paper feed port in which the second paper is set as the paper feed port for alternate printing.

This aspect of the invention can prevent printing to inappropriate paper during alternate printing, and improve usability.

In a printing device according to another aspect of the invention, the paper feed port selector, when the orientation of the first paper and the second paper are also the same, selects the paper feed port in which the second paper is set as the paper feed port for alternate printing.

This aspect of the invention can prevent the user needing to realign the printout because the same print job is discharged with the paper in different orientations.

Further preferably in a printing device according to another aspect of the invention, the paper feed port selector, when the paper type of the first paper and the second paper are also the same, selects the paper feed port in which the second paper is set as the paper feed port for alternate printing.

This aspect of the invention can prevent printing to inappropriate paper during alternate printing, and improve usability.

Further preferably in a printing device according to another aspect of the invention, the group includes multiple subgroups; and the paper feed port selector, when the paper type of the first paper and the second paper are in the same subgroup, selects the paper feed port in which the second paper is set as the paper feed port for alternate printing.

This aspect of the invention uses even more appropriate paper for alternate printing, and improves usability.

Further preferably in a printing device according to another aspect of the invention, the multiple subgroups include a subgroup of a paper type associated with plain paper, and a subgroup of a paper type associated with high chromogenicity paper.

This aspect of the invention can prevent using both plain paper and fine art paper, for example, due to alternate printing.

To achieve the foregoing objective, another aspect of the invention is a printing device having multiple paper feed ports, and executing alternate printing using a second paper set in a different paper feed port when first paper set in a first paper feed port and used for printing is depleted, including: a print job receiver configured to receive a print job including printing conditions; a paper information acquisition unit configured to acquire paper information about paper set in the paper feed ports; a no-paper detector configured to detect depletion of the paper set in the paper feed port; a paper feed port selector configured to select a paper feed port based on the printing conditions and paper information; and a printing process controller configured to supply paper from the selected paper feed port and print; the paper feed port selector selecting the paper feed port to use in alternate printing based on the printing conditions when the no-paper detector detects depletion of the first paper.

This aspect of the invention enables alternate printing appropriate to the print request of the user.

Further preferably in another aspect of the invention, when the printing conditions include a request to use a stapler function or sorter function, the paper feed port selector, when the paper type of the first paper and the second paper are the same, selects the paper feed port in which the second paper is set as the paper feed port for alternate printing.

This aspect of the invention prevents needing to reprint an entire print job, which can happen when alternate printing uses paper of a different paper type.

Further preferably in another aspect of the invention, the paper feed port selector, when the paper size and the paper type of the first paper and the second paper are the same, selects the paper feed port in which the second paper is set as the paper feed port for alternate printing.

This aspect of the invention can prevent printing problems such as missing images and characters because the images and characters to be printed do not fit on the selected print medium.

Further preferably in another aspect of the invention, when the printing conditions include a request to use a stapler function or sorter function, the paper feed port selector, for the duration of one print job, does not select the paper feed port in which the second paper is set.

This aspect of the invention can prevent needing to reprint an entire print job, which can happen with alternate printing using paper of a different paper type.

Further preferably in another aspect of the invention, when the printing conditions include a request to use a stapler function or sorter function, the paper feed port selector, when the print job requests printing multiple sets, selects the paper feed port to use for alternate printing at a break between sets.

This aspect of the invention can prevent needing to reprint part of a print job, which can happen with alternate printing using paper of a different paper type.

Further preferably in another aspect of the invention, when the print request includes a fax printing request, the paper feed port selector, when the no-paper detector detects depletion of the first paper, selects the paper feed port in which the second paper is set as the paper feed port for alternate printing if the paper size of the first paper and the second paper are the same.

This aspect of the invention prioritizes printing when a fax is received, enabling reliably transmitting the communicated content to the receiver.

Further preferably in another aspect of the invention, when the printing conditions include a request to use paper of a standard size, the paper feed port selector, when the no-paper detector detects depletion of the first paper, asks the user whether or not to allow alternate printing.

This aspect of the invention can prevent wasting expensive paper of a standard size, such as postcard media and envelopes.

Further preferably in another aspect of the invention, the printing device is an inkjet printer.

This aspect of the invention enables appropriate alternate printing by a printer using a printing method that is easily affected by the paper type.

To achieve the foregoing objective, another aspect of the invention is a control method of a printing device having multiple paper feed ports, and executing alternate printing using a second paper set in a different paper feed port when first paper set in a first paper feed port and used for printing is depleted, including: a print job receiving step of receiving a print job including printing conditions; a paper information acquisition step of acquiring paper information about paper set in the paper feed ports; a no-paper detection step of detecting depletion of the paper set in the paper feed port; a paper feed port selection step of selecting a paper feed port based on the printing conditions and paper information; and a printing process control step of supplying paper from the selected paper feed port and printing; the paper feed port selection step, when the no-paper detection step detects depletion of the first paper, the paper size of the first paper and the second paper is the same, and the paper type of the first paper and the second paper is included in the same group of predetermined paper type groups, selecting the paper feed port in which the second paper is set as the paper feed port for alternate printing.

This aspect of the invention can prevent printing to inappropriate paper during alternate printing, and improve usability.

Other objects and attainments together with a fuller understanding of the invention will become apparent and appreciated by referring to the following description and claims taken in conjunction with the accompanying drawings.

DESCRIPTION OF EMBODIMENTS

Figure 1:
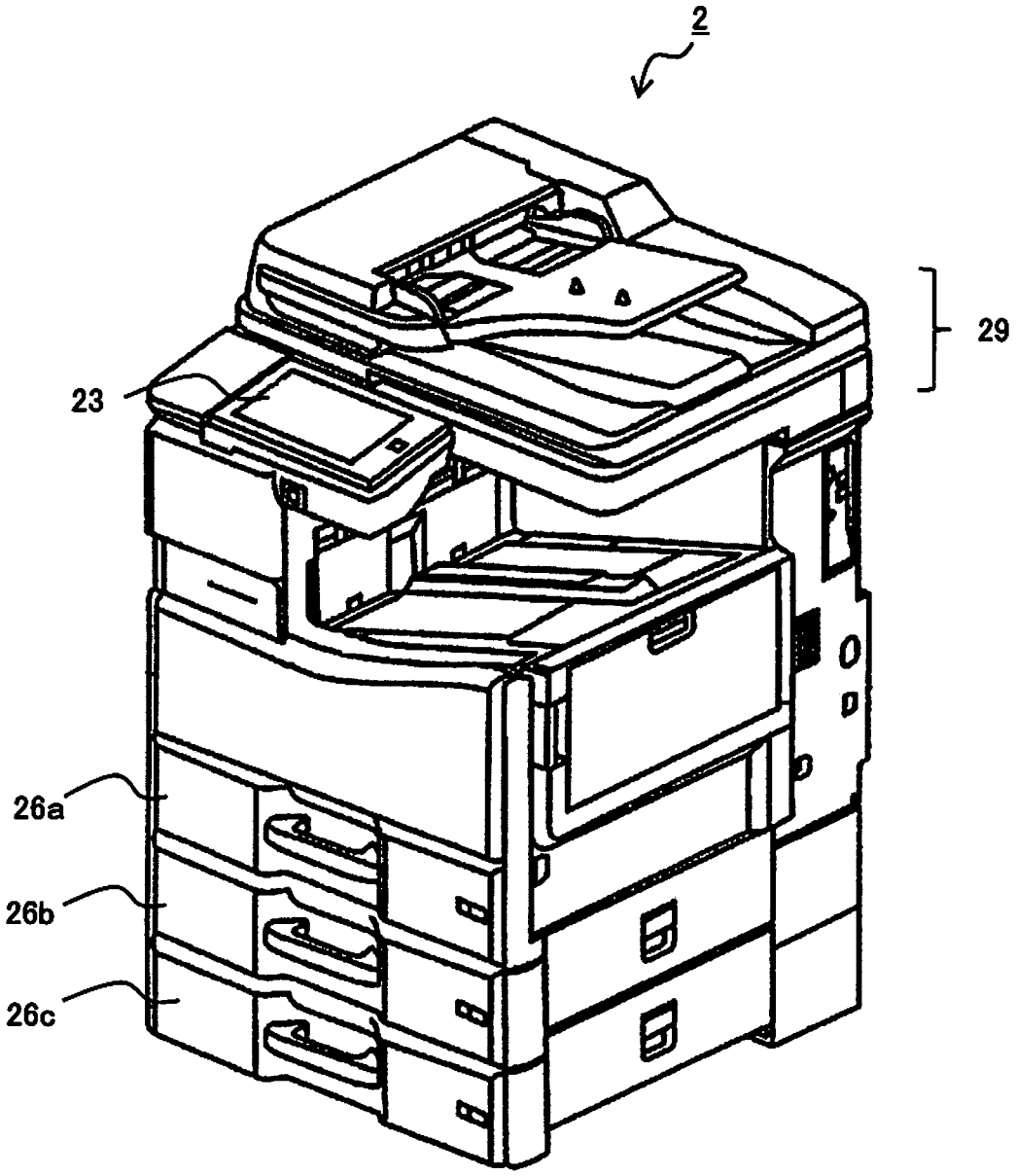
FIG. 1 is an oblique view of a printing device according to the invention.

An embodiment of the present invention is described below with reference to the accompanying figures. However, the embodiment described below does not limit the technical scope of the invention. Note that in the figures like or similar parts are identified by the same reference numerals or reference symbols.

Note that a multifunction printer as described below is an apparatus (device) incorporating the functions of a printer, scanner, and fax machine in a single unit.

FIG. 1 is an external oblique view of a printer according to the invention. The printer 2 shown in FIG. 1 embodies the technology of the invention. This printer 2 is a relatively large multifunction printer that is typically used in offices or retail environments such as convenience stores.

When the printer 2 is used as a copier, for example, the user may place multiple document pages to be copied in an ADF (Automatic Document Feeder). When the user then asserts a Copy command on the operating panel 23, the ADF feeds the loaded document one sheet at a time, and the scanner 29 sequentially reads data representing the document. The printer 2 then sequentially prints the document content on the paper (the supplied paper) fed from the paper supply (paper cassette) 26. When printing (copying) to the paper is completed, the paper is discharged to a face-down paper exit 22, or a face-up paper exit 20.

Furthermore, when used in an office environment, the printer 2 prints according to print requests from a host computer 1, and more specifically receives print data from a host computer 1 and prints according to the print data.

This printer 2 has an alternate printing function that supplies paper from a different paper feed port (paper cassette) 26 to continue printing when the paper supply in the paper feed port (paper cassette) 26 being used runs out, and when no paper is detected while printing, determines whether or not to start alternate printing based on the paper size, paper type, and feed direction (orientation). The printer 2 also changes the paper selection method for alternate printing according to the print request. Unlike alternate printing according to the related art that considers only the paper size, this enables alternate printing appropriate to the print request. Mixing different types of paper can therefore be avoided, degrading the appearance of the printout can be prevented, and usability can be improved.

Note that the paper type as used here refers to the quality of the paper. The paper can be classified by the paper type as plain paper, cardboard, recycled paper, letterhead, color paper, used paper, and fine art paper (high chromogenicity paper), for example.

Figure 2:
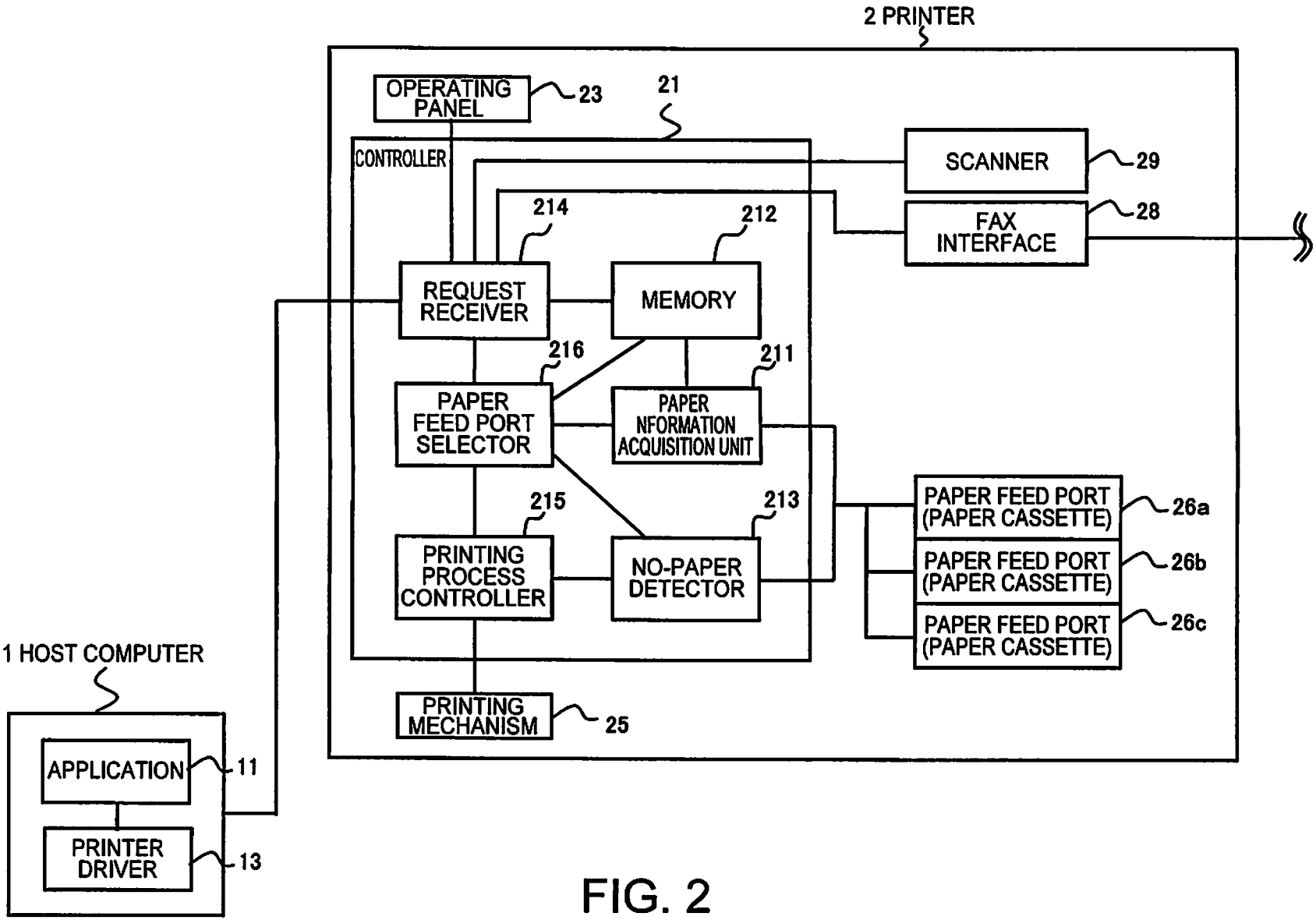
FIG. 2 is a block diagram of a printer 2 according to the invention.

FIG. 2 is a block diagram schematically illustrating the configuration of the printer 2.

The host computer 1 is the host device of the printer 2, and in this example is a personal computer including, not shown, a CPU, RAM, hard disk drive, display, communicator, and operating device not shown. The functional configuration of the host computer 1 includes, as shown in FIG. 2, an application 11 and a printer driver 13.

The application 11 is an application program that outputs print requests to the printer 2.

The printer driver 13 embodies the printer 2 driver functions. The printer driver 13 receives print data output from the application 11, and generates and sends to the printer 2, based on the print data received from the application 11, print data expressed by print commands for the printer 2.

Note that the application 11 and printer driver 13 are embodied by a program defining the processes to execute, a CPU that executes the program, and RAM, for example.

The printer 2 in this example is a relatively large multifunction printer used in an office environment or retail environment such as a convenience store. The printer 2 has an alternate printing function as described above. As shown in FIG. 2, the functional configuration of the printer 2 includes a controller 21, operating panel 23, printing mechanism 25, paper feed port (paper cassette) 26 (26*a*, 26*b*, 26*c*), fax interface 28, and scanner 29. The printer 2 in this example is an inkjet line printer.

The controller 21 controls other parts of the printer 2. When a print request is received from the host computer 1, the controller 21 executes a process according to the commands contained in the print data transmitted from the host computer 1.

When the printer 2 functions as a scanner, the controller 21 captures the content of the document on the scanner platen as image data.

When functioning as a copier, the controller 21 captures the content of the document on the scanner platen as image data, and then prints based on the captured image data.

When functioning as a fax machine, the printer 2 captures the content of the document to be transmitted as image data, and then sends the captured image data to the specified telephone number.

As shown in FIG. 2, the functional configuration of the controller 21 includes a paper information acquisition unit 211, memory 212, paper feed port selector 216, request receiver (print job receiver) 214, no-paper detector 213, and printing process controller 215.

While not shown in the figures, hardware components of the controller 21 may include a CPU, ROM, RAM, ASIC, or other device.

The request receiver 214 receives requests to use the functions described above. More specifically, the request receiver 214 receives print requests (print jobs, print data) sent from the host computer 1; print requests (print jobs) when instructed through the operating panel 23 to make copies; and print requests (print jobs) received through the fax interface 28 when a fax is received.

The paper information acquisition unit 211 acquires information about the paper (referred to below as paper information) loaded in each paper feed port 26 (26*a*, 26*b*, 26*c*). The paper information includes such information as the paper size, paper type, and feed direction (orientation). More specifically, when the user loads paper, the paper information acquisition unit 211 acquires information input through the operating panel 23 and by sensors disposed to the paper feed paper feed port (paper cassette) 26.

The memory 212 stores information about the paper contained in groups that allow alternate printing as described below. The memory 212 is nonvolatile memory such as NVRAM.

The paper feed port selector 216 selects the paper feed port (paper cassette) 26 to use for printing based on the printing conditions contained in the print request the request receiver 214 received, and the paper information the paper information acquisition unit 211 acquired. The printer 2 according to the invention is characterized by the process executed by the paper feed port selector 216 to select the paper feed port (paper cassette) 26 to use in alternate printing.

The no-paper detector 213 detects if any paper feed port (paper cassette) 26 has run out of paper. If a no-paper state is detected, the no-paper detector 213 reports the no-paper state to the printing process controller 215.

Note that the request receiver 214, paper information acquisition 211, paper feed port selector 216, and no-paper detector 213 may be embodied by a program (firmware) stored in printer 2 ROM (not shown in the figure), and a CPU that operates according to the program.

The printing process controller 215 control printing by the printer 2. More specifically, when a print request is received from the host computer 1 through the request receiver 214, the printing process controller 215 renders the content to print as image data for each pixel, and passes the image data to the printing mechanism 25 to execute the printing process. The paper feed port (paper cassette) 26 used in the printing process is the paper feed port selected by the paper feed port selector 216.

The operating panel 23 is the user interface of the printer 2, and has a display panel for displaying information to the user, and an operating panel through which the user inputs information and commands. The user uses the operating panel 23 when using the copier function or scanner function. The display panel may have LEDs that light stead or blink, or an LCD panel capable of presenting short text messages, and the operating panel may have physical buttons and switches or a touch panel, for example.

The scanner 29 reads (scans) the content of a loaded document, and has an ADF. The ADF feeds the loaded documents one sheet at a time to the scanning position.

The fax interface 28 connects to a telephone network, and can send and receive data by facsimile transmissions.

The paper feed port (paper cassette) 26 is a means of feeding paper to the printing position, a cassette in which paper is stored (set) is inserted to each paper feed port 26*a*, paper feed port 26*b*, and paper feed port 26*c*, and the paper is supplied from each cassette. The printer 2 in this example has multiple paper feed ports (paper cassettes) 26 (three in this example). The user can load paper of different sizes, types, and orientations in the multiple paper feed ports.

The printing mechanism 25 executes printing processes on paper as controlled by the printing process controller 215. The printing mechanism 25 has a printhead (a line head in this example) with multiple nozzles for ejecting ink onto the paper. The printing mechanism 25 also includes a conveyance mechanism. The conveyance mechanism includes conveyance rollers, drive devices for driving the conveyance rollers, and a conveyance path (all not shown). The conveyance mechanism conveys the paper to the printing position and discharges the printed paper from a paper exit.

A feature of the printer 2 thus comprised is the process controlling printing on alternative paper, and steps in the alternate printing process are described below in first to fourth embodiments described below.

Note that the following embodiments all share the same functional configuration of shown in FIG. 2.

Figure 4:
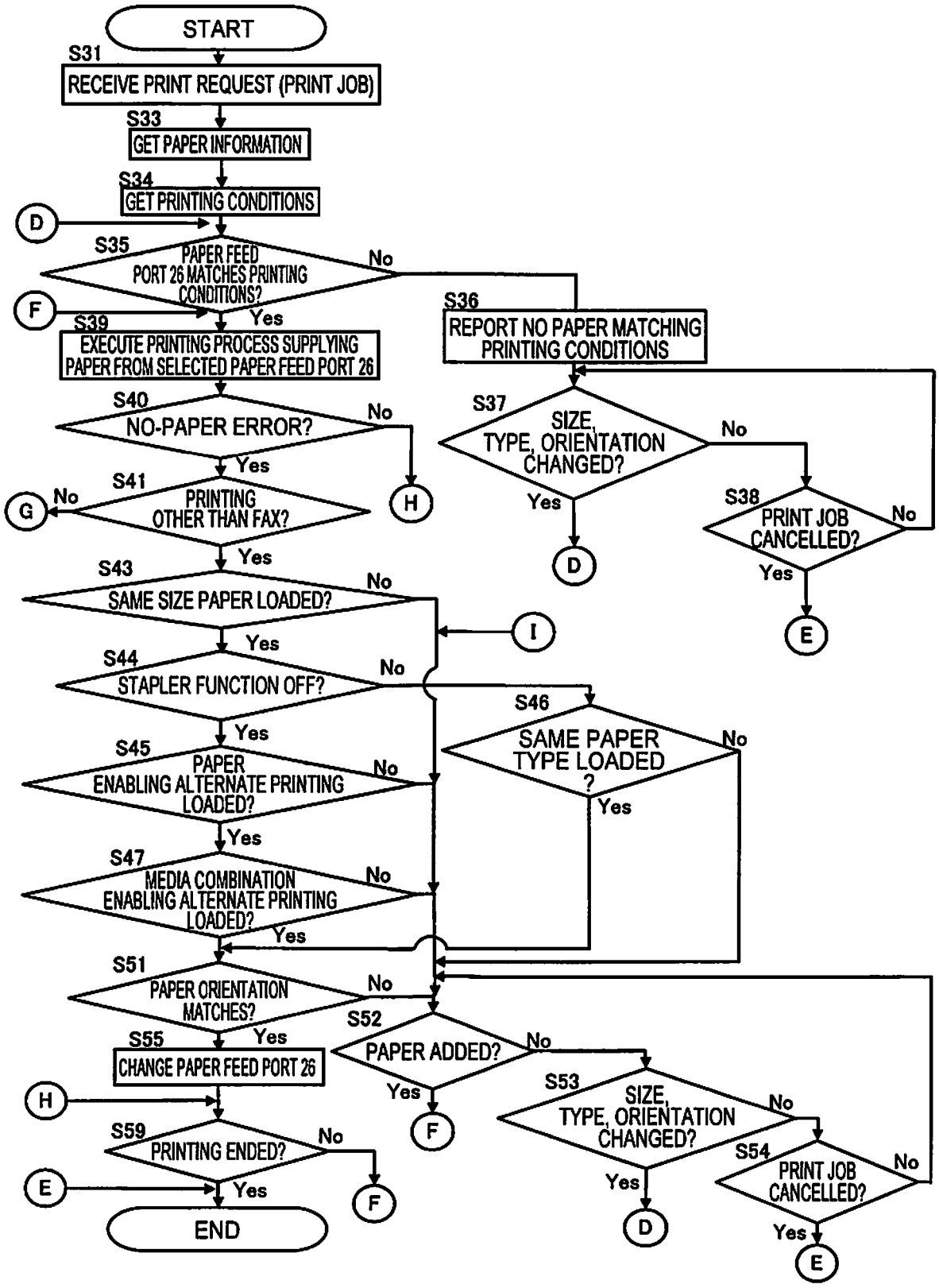
FIG. 4 is a flow chart of steps in a printing process including alternate printing according to second through fourth embodiments of the invention.

The flow chart in FIG. 4 includes all processes of the second to fourth embodiments, and the second embodiment and third embodiment do not execute some steps in the process.

Embodiment 1

Steps in a printing process including alternate printing according to a first embodiment of the invention is described next.

Figure 3:
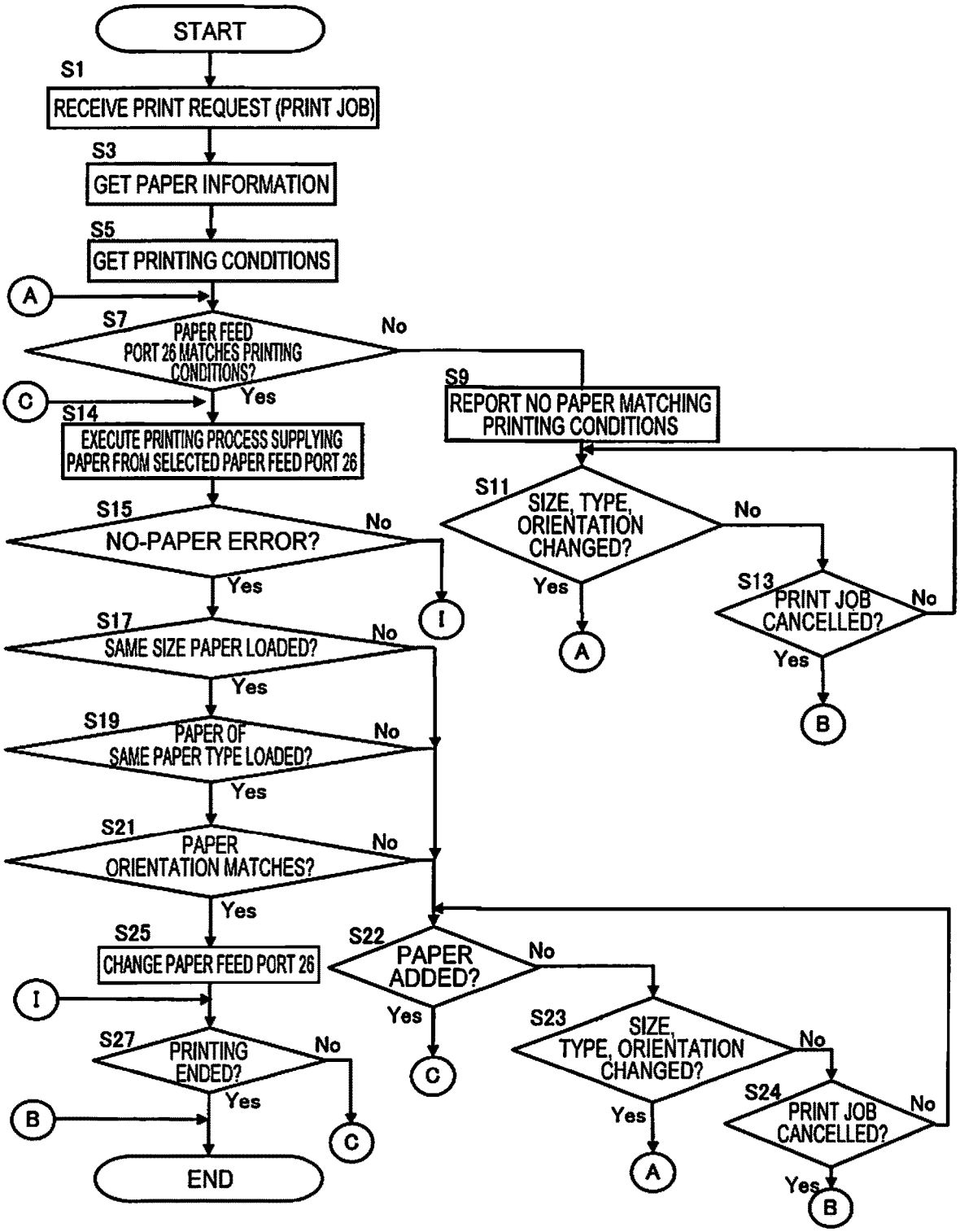
FIG. 3 is a flow chart of steps in a printing process including alternate printing according to a first embodiment of the invention.

FIG. 3 is a flow chart of steps in this process.

In the first embodiment, when the paper feed port (paper cassette) 26 being used in the executing printing process runs out of paper, and there is a paper feed port (paper cassette) 26 holding paper of the same size, type, and orientation as the paper (first paper) used until the paper ran out, printing (alternate printing) continues using the paper (second paper) stored in that paper feed port (paper cassette) 26. If paper matching all conditions is not present, printing does not continue in the alternate printing mode.

The user first asserts a print request through the host computer 1 or the operating panel 23. When printing is requested from the host computer 1, the user executes an operation to print through the application 11. More specifically, the user asserts a print request through the user interface displayed by the printer driver 13. To assert a print request from the operating panel 23, the user may push the Copy button on the operating panel to start copying. In these instances in this example, the paper feed port (paper cassette) 26 selection is set to automatic.

When such an operation is performed, the request receiver 214 receives the print request (print data, print job) (step S1 in FIG. 3). When the print data is received, the request receiver 214 passes the print data to the paper feed port selector 216, and the paper feed port selector 216 acquires the printing conditions contained in the print data (step S3 in FIG. 3). More specifically, the paper feed port selector 216 acquires the paper size, paper type, and paper feed orientation (settings) from the printing conditions contained in the print request data. This example supposes the user set the paper size to A4, the paper type to Plain Paper, and the paper feed orientation is set to portrait orientation (short edge feed).

Next, the paper information acquisition unit 211 acquires and passes to the paper feed port selector 216 the paper information of the paper that is set in each of the paper feed ports (paper cassettes) 26 (step S5 in FIG. 3). Next, the paper feed port selector 216, based on the received printing conditions and paper information, determines if there is a paper feed port (paper cassette) 26 holding paper matching the printing conditions (step S7 in FIG. 3).

In this example, there is a paper feed port (paper cassette) 26*a* holding paper matching the printing conditions, that is, A4-size plain paper loaded in the portrait orientation.

In this case, because there is a paper feed port (paper cassette) 26*a* holding paper matching the printing conditions, that is, A4-size plain paper loaded in the portrait orientation, (step S7 in FIG. 3: Yes), the paper feed port selector 216 selects paper feed port (paper cassette) 26*a* as the paper feed port (paper cassette) 26 to use for printing. After receiving the print command, the printing process controller 215 executes a printing process supplying paper from the selected paper feed port (paper cassette) 26 (step S14 in FIG. 3). More specifically, the printing process controller 215 executes the printing process by supplying paper from the paper feed port (paper cassette) 26*a* holding paper matching the printing conditions, that is, A4-size plain paper loaded in the portrait orientation. As a result, if there is a paper feed port (paper cassette) 26 holding paper matching the printing conditions, the printing process is executed on paper supplied from that paper feed port.

However, if there is not a paper feed port (paper cassette) 26*a* holding paper matching the printing conditions, that is, A4-size plain paper loaded in the portrait orientation, that is, a paper feed port (paper cassette) 26 holding paper matching the printing conditions is not installed, (step S7 in FIG. 3: No), control goes to step S9, and the paper feed port selector 216 reports to the user that a paper feed port (paper cassette) 26 matching the printing conditions is not installed (step S9 in FIG. 3). More specifically, the paper feed port selector 216 reports this information through the printer driver 13 or operating panel 23, presenting a message indicating that "a paper cassette matching the printing conditions is not installed" in the user interface of the host computer 1, or on the display panel of the operating panel 23. This report may obviously also be made audibly.

Control then goes to step S11, and the paper feed port selector 216 checks if the user changed the paper size, paper type, or paper feed orientation in the printing conditions (step S11 in FIG. 3). If no change was made (step S11 in FIG. 3: No), control goes to step S step S13, and the paper feed port selector 216 checks if the user cancelled the print job (step S13 in FIG. 3).

If step S11 determines the user changed the paper size, paper type, or paper feed orientation (step S11 in FIG. 3: Yes), control goes to step S7 and the foregoing process repeats.

If the result of step S13 is that the user did not cancel the print job (step S13 in FIG. 3: No), control goes to step S11 and the process repeats.

If the user cancelled the print job (step S13 in FIG. 3: Yes), the printing process ends.

When control goes to step S14, the printing process is executed supplying paper from a paper feed port (paper cassette) 26 that met the printing conditions in step S7, and while the printing process executes, the no-paper detector 213 monitors whether or not a no-paper state occurs (step S15 in FIG. 3). If the no-paper detector 213 does not detect a no-paper state (step S15 in FIG. 3: No), processing proceeds from step S27. If the printing process controller 215 determines the printing process has not ended (step S27 in FIG. 3: No), control returns to step S14 and printing continues. If printing has ended (step S27 in FIG. 3: Yes), the printing process controller 215 ends the printing process.

If in step S15 the no-paper detector 213 detected a no-paper state (step S15 in FIG. 3: Yes), control goes to step S17, and the paper feed port selector 216 checks if there is a paper feed port (paper cassette) 26 holding paper of the same size as the paper size in the printing conditions (step S17 in FIG. 3). Based on the suppositions of this example described above, the paper feed port (paper cassette) 26 checks if there is a paper feed port (paper cassette) 26 holding A4-size paper. If there is a paper feed port (paper cassette) 26 holding A4-size paper (step S17 in FIG. 3: Yes), control goes to step S19. If there is not a paper feed port (paper cassette) 26 holding A4-size paper (step S17 in FIG. 3: No), control goes to step S22.

The paper feed port selector 216 then determines if the one or more paper feed ports (paper cassettes) 26 holding the same size of paper as defined in the printing conditions include a paper feed port (paper cassette) 26 holding paper of the same paper type as the paper type in the paper information contained in the printing conditions (step S19 in FIG. 3).

Based on the suppositions described above, the paper feed port selector 216 in this example determines if there is a paper feed port (paper cassette) 26 holding A4-size paper that is also plain paper. If there is a paper feed port (paper cassette) 26 holding the same size of paper as the paper size defined in the printing conditions, and the type of paper in that paper feed port (paper cassette) 26 is plain paper, (step S19 in FIG. 3: Yes), control goes to step S21. However, if there is not a paper feed port (paper cassette) 26 holding the same type and size of paper (step S19 in FIG. 3: No), control goes to step S22.

The paper feed port selector 216 then determines if the paper feed ports (paper cassettes) 26 holding the same size and the same type of paper as defined in the printing conditions include a paper feed port (paper cassette) 26 holding paper in the same orientation as defined in the printing conditions (step S21 in FIG. 3).

Based on the suppositions described above, the paper feed port selector 216 in this example determines if there is a paper feed port (paper cassette) 26 holding A4-size plain paper in the portrait orientation (short edge feed orientation). If there is a paper feed port (paper cassette) 26 holding the same size and type of paper as the paper size defined in the printing conditions, and the orientation of the paper in that paper feed port (paper cassette) 26 is the portrait orientation, (step S21 in FIG. 3: Yes), control goes to step S25. However, if the paper feed ports (paper cassettes) 26 holding the same size and type of paper as the paper size defined in the printing conditions do not include a paper feed port (paper cassette) 26 holding the paper in the portrait orientation (step S21 in FIG. 3: No), control goes to step S22.

Because in step S25 there is a paper feed port (paper cassette) 26 installed with paper of the paper size, paper type, and orientation all matching the printing conditions, the paper feed port selector 216 selects that paper feed port (paper cassette) 26 as the new (alternative) paper feed port for supplying paper to the printing process (step S25 in FIG. 3).

Next, control goes to step S27, and the printing process controller 215 continues the printing process by supplying paper from the alternate paper feed port (paper cassette) 26 selected in step S25 (step S27 in FIG. 3). In other words, the printing process controller 215 selects paper from a different paper feed port (paper cassette) 26 and continues printing (executes alternate printing).

The printing process controller 215 then determines if printing ended, and if printing continues (step S27 in FIG. 3: No), repeats the process from step S14. If printing has ended (step S27 in FIG. 3: Yes), the printing process controller 215 ends the printing process.

If No is returned in step S17, step S19, or step S21, control goes to step S22, and paper feed port selector 216 determines if paper matching the size, type, and orientation defined in the printing conditions was added to the paper feed port (paper cassette) 26 selected in step S7 (step S22 in FIG. 3).

If the user added such paper to the paper feed port (paper cassette) 26 (step S22 in FIG. 3: Yes), control goes to step S14 and the printing process continues.

However, if the user did not add paper (step S22 in FIG. 3: No), control goes to step S23, and the paper feed port selector 216 determines if the paper size, paper type, or orientation of the printing conditions changed (step S23 in FIG. 3).

If a change was made (step S23 in FIG. 3: Yes), control goes to step S7 and the above process repeats.

If a change was not made (step S23 in FIG. 3: No), control goes to step S24, and unless the print job was cancelled by the user (step S24 in FIG. 3: No), the process repeats from step S22.

If the print job is cancelled by the user (step S24 in FIG. 3: Yes), the printing process ends.

The process described above is executed each time there is a print request from the copier function or a print request from the host computer 1.

In a variation of the above process, alternate printing may be executed if the paper size and paper type match but the orientation does not match the printing conditions.

Embodiment 2

The content of a printing process including alternate printing according to the second embodiment of the invention is described below as a variation of the first embodiment.

The content of the process executed in the second embodiment is substantially the same as the first embodiment, and is characterized by allowing printing to continue if the paper type is not a complete match, but the paper is of a type included in a predetermined group allowing alternate printing. In other words, alternate printing is allowed even if the paper type does not completely match the paper type in the printing conditions. However, if the size of the supplied paper is a specific standard size (such as postcard or envelope size), a no-paper error is reported and the user is asked whether or not to continue printing.

Note that fine art paper and paper of other certain paper types differ by the color of the finished printout. Alternate printing may therefore be allowed only if the paper defined in the printing conditions and the candidate paper for alternate printing are both fine art paper. One enabling method creates a subgroup including fine art paper, and a subgroup including papers of other paper types, as subgroups of a group allowing alternate printing, and allows alternate printing using papers of a paper type included in the same subgroup.

Note that papers in the group allowing alternate printing in this embodiment of the invention include, for example, plain paper 1, plain paper 2, cardboard 1, cardboard 2, recycled paper, letterhead, color paper, used paper, and fine art paper, and papers with similar grammage and a surface finish similar to plain paper. The subgroups in this example are a subgroup of plain paper, and a subgroup of fine art paper. Information about the group allowing alternate printing and subgroups is previously stored in memory 212.

FIG. 4 is a flow chart of steps in a printing process including alternate printing in the second to fourth embodiments.

Note that step S41, step S44, and step S46 are not executed in the second embodiment.

As will be understood by comparison with the process in FIG. 3 and FIG. 4, the process of the second embodiment replaces step S19 in FIG. 3 with step S45 and step S47 in FIG. 4. Only the differences therebetween are therefore described below. Other parts of the process are as described in the first embodiment described above.

In step S45, the paper feed port selector 216 determines if there is a paper feed port (paper cassette) 26 storing paper of the paper type specified in the printing conditions or paper included in the group allowing alternate printing (step S45 in FIG. 4). More specifically, the paper feed port selector 216 checks the paper information in the printing conditions, and the paper information of the group allowing alternate printing stored in the memory 212, and determines if the paper feed ports (paper cassettes) 26 holding paper of the same size as the paper in the printing conditions include a paper feed port (paper cassette) 26 storing paper of a paper type included in the group allowing alternate printing. If such a paper feed port (paper cassette) 26 is not found (step S45 in FIG. 4: No), control goes to step S52.

If such a paper feed port (paper cassette) 26 is found (step S45 in FIG. 4: Yes), control goes to step S47 or step S51. To select paper in a subgroup, control goes to step S47. In step S47, the paper feed port selector 216 checks if there is a combination allowing alternate printing (step S47 in FIG. 4).

More specifically, the paper feed port selector 216 checks whether or not a paper feed port (paper cassette) 26 holding paper of the paper type included in the same subgroup as the paper type of the printing conditions is also a paper feed port (paper cassette) 26 holding paper of the same size as the paper size in the printing conditions. If such a paper feed port (paper cassette) 26 is not found (step S47 in FIG. 4: No), control goes to step S52. If there is such a paper feed port (paper cassette) 26 (step S47 in FIG. 4: Yes), control goes to step S51.

If a decision based on the subgroup is not made, step S45 returns Yes, and control goes to step S51.

The remaining process executes in the same way as when a print request to make a copy, or a print request from the host computer 1, is received.

Embodiment 3

The content of a printing process including alternate printing according to the third embodiment of the invention is described below as a variation of the second embodiment.

The content of the process executed in the third embodiment is substantially the same as the second embodiment. This embodiment differs in the addition of a process that executes when a finishing function, such as stapling or collating (shifting), is specified by the user. When a finisher function is specified, alternate printing is allowed only when the paper type matches, and alternate printing is not allowed even if paper included in a group allowing alternate printing as described in the second embodiment is loaded.

Note that in the third embodiment, step S41 in FIG. 4 does not execute.

The third embodiment of the invention adds step S44 and step S46 to the process of the second embodiment, and other parts of the process are the same. The remaining parts of the process shown in FIG. 4 are the same as in the second embodiment.

In step s43 in FIG. 4, if there is a paper feed port (paper cassette) 26 storing paper of the same size as the paper size in the printing conditions (step S43 in FIG. 4: Yes), control goes to step S44, and the paper feed port selector 216 determines if the stapler or collation (shifting) function were turned on by the user in the printing conditions (step S44 in FIG. 4). If a stapler or other finisher function was turned on (enabled) by the user (step S44 in FIG. 4: No), control goes to step S46.

However, if the finisher functions are off (disabled) (step S44 in FIG. 4: Yes), control goes to step S45.

In step S46, the paper feed port selector 216 determines whether or not a paper feed port (paper cassette) 26 holding paper of the same paper type as the paper type of the printing conditions is also a paper feed port (paper cassette) 26 holding paper of the same size as the paper size in the printing conditions (step S46 in FIG. 4). If such a paper feed port (paper cassette) 26 is found (step S46 in FIG. 4: Yes), control goes to step S51. If there is not such a paper feed port (paper cassette) 26 (step S46 in FIG. 4: No), control goes to step S52.

Note that step S53 checks for changes in printing conditions including the on/off state of a stapler or other finisher function.

Note that alternate printing may be turned off if a stapler or other finisher function is on (enabled). If the print job includes producing multiple copies, and the paper supply runs out at the end of one copy, alternate printing using paper from a different paper feed port (paper cassette) 26 may proceed, in which case step S46 in FIG. 4 may execute, or steps S45 and S47 may execute instead of step S46. More specifically, alternate printing proceeds if there is a paper feed port (paper cassette) 26 storing paper of the same paper type as the paper type in the printing conditions. Alternate printing may also proceed if there is a paper feed port (paper cassette) 26 holding paper of a paper type included in the group allowing alternate printing of the same paper type as specified in the printing conditions. Note that a decision based on the subgroup may or may not be made.

The remaining process executes in the same way as when a print request to make a copy, or a print request from the host computer 1, is received.

Embodiment 4

The content of a printing process including alternate printing according to a fourth embodiment of the invention is described below as a variation of the third embodiment.

Figure 5:
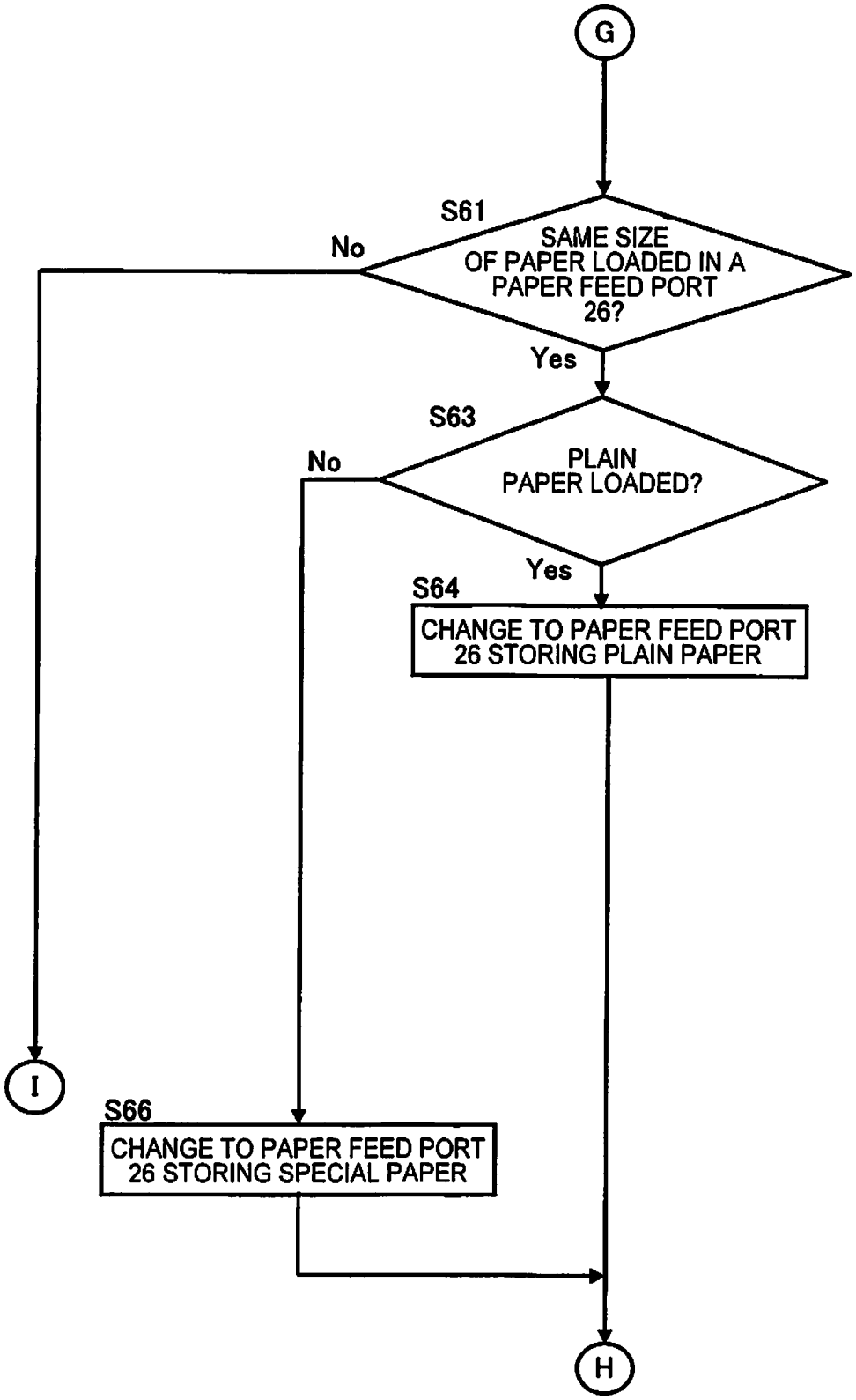
FIG. 5 is a flow chart of steps in a printing process including alternate printing according to a fourth embodiment of the invention.

FIG. 4 and FIG. 5 are flow charts of the printing process according to a fourth embodiment of the invention. The process of the fourth embodiment adds a process executed when the fax function is used to the process of the third embodiment described above. Other than step S41, the process in FIG. 4 is therefore the same as the process of the third embodiment. Steps S41 to S66 in FIG. 4 and FIG. 5 are described below.

Note that the following description differentiates between plain paper and special paper.

Because the printer 2 according to this embodiment may also receive fax data from another device through the fax interface 28, when step S40 in FIG. 4 returns Yes, the paper feed port selector 216 determines if the print request is to print a fax (step S41 in FIG. 4). If the request is not a fax printing request (step S41 in FIG. 4: Yes), control goes to step S43.

If the request is to print a fax (step S41 in FIG. 4: No), control goes to step S61 in FIG. 5.

In step S61, the paper feed port selector 216 determines if there is a paper feed port (paper cassette) 26 holding paper of the same size as in the printing conditions (step S61 in FIG. 5). If there is a paper feed port (paper cassette) 26 holding the same size of paper (step S61 in FIG. 5: Yes), control goes to step S63, and the paper feed port selector 216 determines if that paper feed port (paper cassette) 26 is a paper feed port (paper cassette) 26 holding plain paper (step S63 in FIG. 5). If that paper feed port (paper cassette) 26 is a paper feed port (paper cassette) 26 holding plain paper (step S63 in FIG. 5: Yes), the paper feed port selector 216 changes the paper feed port to that paper feed port (paper cassette) 26. (step S64 in FIG. 5). The process then goes to step S59 in FIG. 4, and printing using plain paper supplied from the selected paper feed port (paper cassette) 26 starts.

However, if the type of paper held in the paper feed port (paper cassette) 26 holding the same size of paper is not plain paper (is special paper) (step S63 in FIG. 5: No), the paper feed port selector 216 changes the paper feed port to the paper feed port (paper cassette) 26 holding the special paper (step S66 in FIG. 5). The process then goes to step S59 in FIG. 4, and printing using the special paper starts.

If step S61 determines no paper feed port (paper cassette) 26 holds paper of the same size as specified in the printing conditions (step S61 in FIG. 4: No), control goes to step S52, and alternate printing does not proceed.

Thereafter, the process prints each time fax data is received.

As described above, a printer 2 in this example detects if paper runs out while printing, and controls whether or not to proceed with alternate printing based on the paper size and paper type. More particularly, alternate printing is allowed even if the type of paper does not completely match the specified paper type but paper in a group allowing alternate printing is loaded.

Printing to inappropriate paper during alternate printing can therefore be prevented, and usability can be improved.

Furthermore, because the paper feed port selector 216 also allows alternate printing when the condition of whether or not the orientation of the paper (second paper) selected for alternate printing is the same as the orientation of the paper (first paper) that was used for printing until the paper ran out, problems such as the portions of the same print job being discharged in different orientations, and the user needing to align the printouts, are prevented.

Furthermore, because the paper feed port selector 216 also allows alternate printing when the condition of whether or not the paper type of the paper (second paper) selected for alternate printing is the same as the paper type of the paper (first paper) that was used for printing until the paper ran out, problems such as printing to the wrong (inappropriate) type of paper is prevented, and usability can be improved.

Furthermore, because the group allowing alternate printing includes multiple subgroups, the paper feed port selector 216 also allows alternate printing when the condition of whether or not the paper type of the paper (second paper) selected for alternate printing being in the same subgroup as the paper (first paper) that was used for printing until the paper ran out, appropriate paper is also selected for alternate printing, and usability can be improved.

Furthermore, because the multiple subgroups include a subgroup of paper types associated with plain paper, and a subgroup associated with fine art paper, mixing plain paper and fine art paper in the same print job by alternate printing can be prevented.

Furthermore, because the printer 2 changes the method of selecting the paper feed port (paper cassette) 26 to use for alternate printing changes according to the printing conditions when a no-paper state is detected while printing, alternate printing appropriate to the print request of the user is possible.

Furthermore, when the printing conditions include a command to use a finisher function such as a stapler or sort (collation) function, the paper feed port selector 216 allows alternate printing when the paper type of the paper (second paper) selected for alternate printing is the same as the paper type of the paper (first paper) that was used until then. As a result, the need to reprint the entire print job, which can occur when alternate printing uses paper of a different paper type, can be prevented.

Furthermore, in another embodiment of the invention, when the printing conditions include a command to use a finisher function such as a stapler or sort (collation) function, the paper feed port selector 216 does not allow alternate printing while the same print job is executing. As a result, the need to reprint the entire print job, which can occur when alternate printing uses paper of a different paper type, can be prevented.

Furthermore, in another embodiment of the invention, when the printing conditions include a command to use a finisher function such as a stapler or sort (collation) function, the paper feed port selector 216 allows alternate printing at a break between print sets when the print job requires printing multiple document sets. As a result, the need to reprint, which can occur when alternate printing uses paper of a different paper type, can be prevented.

Furthermore, when the printing conditions include a request to print a fax, the paper feed port selector 216 allows alternate printing when the no-paper detector 213 detects a no-paper state if the size of the paper (first paper) used for printing until then and the size of the paper (second paper) selected for alternate printing, are the same. As a result, printing is prioritized when a fax is received so that the communication (fax) content can be reliably transmitted to the recipient.

When the printing conditions include a request to use a specific standard size of paper, and the no-paper detector 213 detects there is no paper, the paper feed port selector 216 asks the user whether or not to allow alternate printing. As a result, wasting standard size print media that may be expensive, such as postcard size media and envelope size media, can be prevented.

The printer 2 in the foregoing embodiments is an inkjet printer, and is easily affected by the paper type, but is capable of appropriate alternate printing.

The printer 2 is also described as a line inkjet printer, but may be a printer using a different printing method, such as a laser printer.

The printer 2 may also be a standalone, desktop, mobile, or portable printer, for example.

Note that the processes shown in FIG. 3 to FIG. 5 may be executed by a CPU in conjunction with other electronic components (such as an ASIC), or by a CPU alone or other electronic components (such as an ASIC) alone. Processes may also be distributed between multiple CPUs or multiple other electronic components (such as an ASICs).

The scope of the invention is not limited to the embodiments described above, and includes the invention as described in the following claims and equivalents thereof.

The entire disclosure of Japanese Patent Application No. 2016-225701, filed Nov. 21, 2016 is expressly incorporated by reference herein.

What is claimed is:

1. A printing device having multiple paper feed ports, comprising:

a print job receiver configured to receive a print job including printing conditions;

a paper information acquisition unit configured to acquire paper information about paper set in the paper feed ports;

a no-paper detector configured to detect depletion of first paper set in a first paper feed port of the paper feed ports while printing using the first paper set in the first paper feed port;

a paper feed port selector configured to automatically select a second paper feed port of the paper feed ports based on the printing conditions and the paper information in response to detecting the depletion of the first paper set in the first paper feed port; and a printing process controller configured to automatically execute alternate printing using second paper set in the second paper feed port by supplying the second paper from the second paper feed port in response to automatically selecting the second paper feed port based on the printing conditions and the paper information;

the paper feed port selector, when the no-paper detector detects the depletion of the first paper, the paper size of the first paper and the second paper is the same, and the paper type of the first paper and the paper type of the second paper are included in the same group of predetermined paper type groups, selecting the second paper feed port in which the second paper is set as a paper feed port for the alternate printing, and the printing device being an inkjet printer.

2. The printing device described in claim 1, wherein:

the paper feed port selector, when the orientation of the first paper set in the first paper feed port and the second paper set in the second paper feed port are also the same, selecting the second paper feed port in which the second paper is set.

3. The printing device described in claim 1, wherein:

the paper feed port selector, when the paper type of the first paper and the paper type of the second paper are also the same, selects the second paper feed port in which the second paper is set.

4. The printing device described in claim 1, wherein:

the paper feed port selector, when the paper type of the first paper and the paper type of the second paper are in the same group and are different from each other, selects the second paper feed port in which the second paper is set.

5. The printing device described in claim 4, wherein:

the group includes multiple subgroups; and the paper feed port selector, when the paper type of the first paper and the paper type of the second paper are in the same subgroup and are different from each other, selects the second paper feed port in which the second paper is set.

6. The printing device described in claim 5, wherein:

the multiple subgroups include a subgroup of a paper type associated with plain paper, and a subgroup of a paper type associated with high chromogenicity paper.

7. A control method of a printing device having multiple paper feed ports, and executing alternate printing using second paper set in a second paper feed port when first paper set in a first paper feed port and used for printing is depleted, comprising:

a print job receiving step of receiving a print job including printing conditions;

a paper information acquisition step of acquiring paper information about paper set in the paper feed ports;

a no-paper detection step of detecting depletion of the first paper set in the first paper feed port;

a paper feed port selection step of selecting a paper feed port based on the printing conditions and paper information; and a printing process control step of supplying paper from the selected paper feed port and printing using a printhead with multiple nozzles for ejecting ink on the paper;

the paper feed port selection step, when the no-paper detection step detects depletion of the first paper, the paper size of the first paper and the second paper is the same, and the paper type of the first paper and the paper type of the second paper are included in the same group of predetermined paper type groups, selecting the second paper feed port in which the second paper is set; and the paper feed port selection step, when the orientation of the first paper set in the first paper feed port and the second paper set in the second paper feed port are also the same, selecting the second paper feed port in which the second paper is set.

8. The control method described in claim 7, wherein:

the paper feed port selection step, when the paper type of the first paper and the paper type of the second paper are also the same, selects the second paper feed port in which the second paper is set.

9. The control method described in claim 7, wherein:

the paper feed port selection step, when the paper type of the first paper and the paper type of the second paper are in the same group and are different from each other, selects the second paper feed port in which the second paper is set.

10. The control method described in claim 9, wherein:

the group includes multiple subgroups; and the paper feed port selection step, when the paper type of the first paper and the paper type of the second paper are in the same subgroup and are different from each other, selects the second paper feed port in which the second paper is set.

11. The control method described in claim 10; wherein:

the multiple subgroups include a subgroup of a paper type associated with plain paper, and a subgroup of a paper type associated with high chromogenicity paper.

12. The printing device described in claim 1, wherein:

the paper feed port selector, when the first paper is one of plain paper, cardboard, recycled paper, letterhead and color paper and the second paper is different one of the plain paper, the cardboard, the recycled paper, the letterhead and the color paper, determines that the paper type of the first paper and the paper type of the second paper are in the same group.

13. The control method described in claim 7, wherein:

the paper feed port selection step, when the first paper is one of plain paper, cardboard, recycled paper, letterhead and color paper and the second paper is different one of the plain paper, the cardboard, the recycled paper, the letterhead and the color paper, determines that the paper type of the first paper and the paper type of the second paper are in the same group.

* * * * *